US006076662A

United States Patent [19]

Bahten

[11] Patent Number: 6,076,662

[45] Date of Patent: Jun. 20, 2000

[54] PACKAGED SPONGE OR POROUS POLYMERIC PRODUCTS

[75] Inventor: Kristan G. Bahten, Gold River, Calif.

[73] Assignee: Rippey Corporation, El Dorado Hills, Calif.

[21] Appl. No.: 09/275,661

[22] Filed: Mar. 24, 1999

[51] Int. Cl.[7] ..... B65D 75/00

[52] U.S. Cl. ..... 206/207; 206/361; 206/524.1

[58] Field of Search ..... 206/205, 207, 206/209, 484, 484.2, 775, 524.1, 524.3, 361

[56] References Cited

U.S. PATENT DOCUMENTS 3,014,579 12/1961 Lathrop ..... 206/209 X
4,455,293 6/1984 Harvey et al. ..... 206/524.1 X

*Primary Examiner*—Jacob K. Ackun
*Attorney, Agent, or Firm*—Townsend and Townsend and Crew LLP

[57] ABSTRACT

The packaging (420) for sponge or porous polymeric devices, e.g., scrubbing brush. The packaging includes a sponge or porous polymeric device (425) therein. A preservative is included in the packaging to prevent bacterial growth on the sponge device.

17 Claims, 7 Drawing Sheets

PACKAGED SPONGE OR POROUS POLYMERIC PRODUCTS

CROSS-REFERENCES TO RELATED APPLICATIONS

This present application claims priority to U.S. Provisional Patent Application No. 60/079,695 filed Mar. 27, 1998, commonly assigned and hereby incorporated by reference for all purposes.

The following two commonly-owned co-pending applications, including this one, are being filed concurrently and the other one is hereby incorporated by reference in their entirety for all purposes:

1. U.S. patent application Ser. No. 09/275,735, Kristan G. Bahten, titled, "A Method for Packaging Sponge or Porous Polymeric Products," and 2. U.S. patent application Ser. No. 09/275,661, Kristan G. Bahten, titled, "A Packaged Sponge or Porous Polymeric Product."

BACKGROUND OF THE INVENTION

The present invention relates to the manufacture of objects. More particularly, the present invention provides a packaging technique for a sponge or porous polymeric product such as an ultra clean "scrubbing" brush or surface treatment device for the manufacture of integrated circuits, for example. Merely by way of example, the present invention is applied to packaging for a scrubbing device for the manufacture of integrated circuits. But it will be recognized that the invention has a wider range of applicability; it can also be applied to the manufacture of semiconductor substrates, hard disks, and the like.

In the manufacture of electronic devices such as integrated circuits, the presence of particulate contamination, trace metals, and mobile ions on a wafer is a serious problem. Particulate contamination can cause a wide variety of problems such as electrical "opens" or "shorts" in the integrated circuit. These opens and shorts often lead to reliability and functional problems in the affected integrated circuit. Mobile ion and trace metal contaminants can also lead to reliability and functional problems in the integrated circuit. The combination of these factors is the main source of lower device yields on a wafer, thereby increasing the cost of an average functional device on the wafer.

Chemical-mechanical polishing ("CMP") is a commonly used technique for planarizing a film on a wafer prior to subsequent processing of the wafer. CMP often requires introduction of a polishing slurry onto a surface of a film on the semiconductor wafer as the wafer is being mechanically polished against a rotating polishing pad. The slurries typically are water based and can contain fine abrasive particles such as silica, alumina, and other abrasive materials. After polishing is complete, the processed wafers must be cleaned to completely remove residual slurry and other residue from the polishing process to ready the surface for other processing steps such as etching, photolithography, and others.

To clean residual slurry material from the polished surface, cleaning brushes have been used. A cleaning brush of this type often comprises a member that is cylindrical in shape, which generally rotates along a center axis of the cylindrical shaped member. The cleaning brushes are also often made of a foam or porous polymeric material such as polyvinyl alcohol ("PVA"). A combination of rotational movement of the brush and force or pressure placed on the brush against the wafer causes residual slurry materials to be removed from the surface of the wafer. Unfortunately, it has been found that the brushes themselves often contain residual materials from the brush manufacturing process. These residual materials include, among others, residual particles and impurities such as ions and particulate contamination. Given that brushes received directly from a manufacturer are often "dirty" it is difficult to maintain the cleanliness of an integrated circuit manufacturing process by using such dirty brushes. Other impurities also may be introduced to the brush during the packaging process.

In some cases, conventional sponge or porous polymeric materials such as PVA attract microorganisms. More particular, microorganisms such as bacteria often introduce themselves on the wet surfaces and pores of the materials and reproduce at significant rates. These microorganisms contaminate the pores and surface area of the material. They also form particulate contamination, which should not be introduced in the manufacture of electronic devices such as integrated circuits. Furthermore, the microorganisms often degrade the quality of the material, which shortens it's life and resiliency. These and other microorganisms can also degrade the porous polymeric product material.

From the above, it is seen that an improved technique for maintaining cleanliness of a surface treatment device is highly desired.

SUMMARY OF THE INVENTION

According to the present invention, a technique for packaging sponge or porous polymeric products is provided. In an exemplary embodiment, the present invention provides packaging an ultraclean surface treatment device, which includes a scrubbing brush for the manufacture of substrates for the electronics industry.

In a specific embodiment, the present invention provides a storable porous polymeric device. The storable device includes a porous polymeric member, which has an outer surface and a plurality of impurities distributed through the member. The device also includes a preservative applied to the porous polymeric member. A containment package enclosing and sealing the preservative and the porous polymeric member within the containment package also is included. In some embodiments, the preservative prevents substantial growth of an organic material on the member during storage.

In an alternative aspect, the present invention provides a packaging apparatus for porous polymeric members. The packaging apparatus increases a shelf life of the members and also improves cleanliness. The apparatus has a porous polymeric member comprising a volume of polyvinyl alcohol material. A preservative is applied homogeneously through the volume of polyvinyl alcohol. The apparatus also has a containment member applied to enclose and seal the porous polymeric member and the preservative within the containment member. In certain aspects, the preservative prevents substantial growth of an organic matter on the porous polymeric member.

Numerous advantages are achieved using the present invention over conventional techniques. For example, in some embodiments the present invention provides an ultraclean or microclean process for cleaning polymeric products. The present process is easy to use with standard chemicals and provides an improved polymeric product, which tends to introduce fewer particles or impurities onto a substrate to be processed. Additionally, the present brush product is cleaner "out of the box." That is, the present brush product is much cleaner on delivery than the conventional products on the market at the filing date of this present application. Accordingly, the present brush product is easier to use and provides for a more efficient manufacturing process, which is important in the manufacture of integrated circuits, for example. The present invention can also be applied to other porous polymeric products. Furthermore, the improved packaging technique of the present process maintains the cleanliness of the product. The ammonium hydroxide is also readily available, which makes the present method easy to implement. Ammonium hydroxide induces negative zeta potential on the surface of the brush product, which often tends to repel particles from the brush product. Ammonium hydroxide also is easily removable with water in most cases. These and other advantages or benefits are described throughout the present specification and are described more particularly below.

DESCRIPTION OF THE SPECIFIC EMBODIMENTS

Figure 1A:
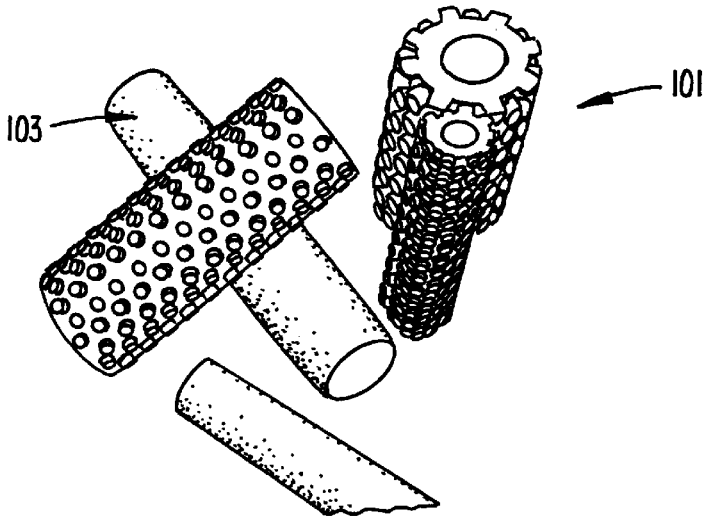
FIG. 1 is a simplified diagram of surface treatment devices according to embodiments of the present invention.
Figure 1B:
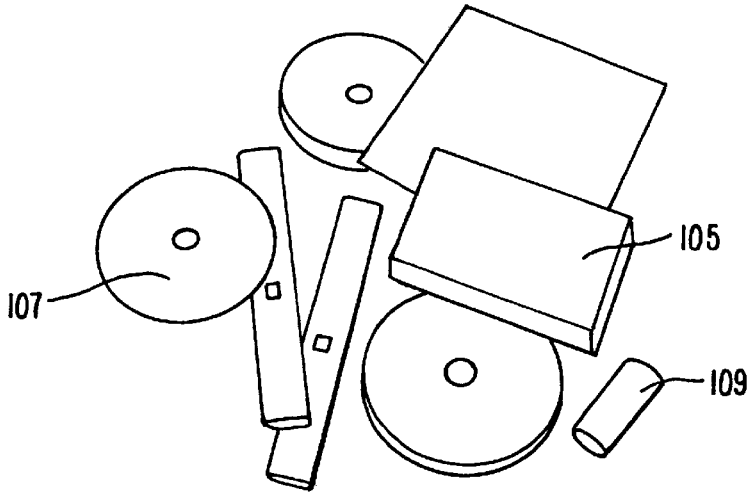
Figure 1C:
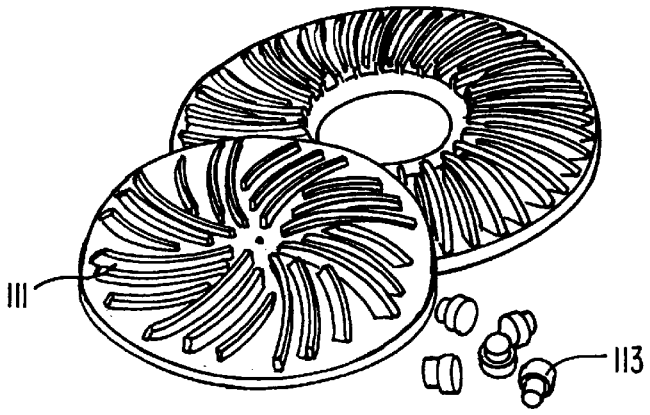

FIG. 1 is a simplified diagram of surface treatment devices according to embodiments of the present invention. This Fig. is merely an illustration and should not limit the scope of the claims herein. One of ordinary skill in the art would recognize other variations, modifications, and alternatives. As shown, the devices or porous polymeric products (e.g., foam products) can range in size and shape, depending upon the application. According to an embodiment, the device can be shaped as brush rollers 101, which have protrusions thereon, or brush rollers 103 that have smooth surfaces. These brush rollers have shapes and sizes to meet the particular cleaning application for devices such as semiconductor wafers, hard disks, and other applications. The device can also be in the form of wipes 105, disks 107, and custom applications 109. Additionally, the device can be in the form of puck brushes 111 and plugs 113. Furthermore, the device can be in other shapes and sizes depending upon the application.

In a specific embodiment, the devices are made using a suitable material that is firm, porous, elastic, and has certain abrasion resistiveness. In most embodiments, the main raw starting material for the device is polyvinyl alcohol, but can be others. For example, polyvinyl alcohol is used to form a polyvinyl acetal porous elastic material. The characteristics of the porous material vary depending on cleanliness, type of foaming agent, type of aldehyde employed for the conversion of a polyvinyl alcohol to a polyvinyl acetal, and other factors. These factors also include the relative proportions of reactants, reaction temperature and time, and the general condition and starting materials in the extrusion process. Cleanliness of the manufacturing process is another important factor in the manufacture of these devices.

Cleaning effectiveness of the device also depends on porosity and the pore size of the device. In most embodiments, the porosity can be more than about 85%. In devices where porosity is less than 85%, polyvinyl acetal porous elastic material may have poor flexibility. In most embodiments, the porosity is less than about 95%, since a greater porosity value may provide poor strength. Other characteristics include a desirable average pore size or opening. The pore size or opening in some embodiments ranges from about 10 microns to about 200 microns. In devices where the average pore opening is less than 10 microns, the porous elastic material may have poor elasticity, thus making the performance of the cleaning roll unsatisfactory. Alternatively, an average pore opening of more than 200 microns can be unsuitable for a cleaning roll because of inconsistent pore configuration. Of course, the selected pore size and porosity depend upon the application.

The polyvinyl acetal porous elastic material usable for the present invention can be produced in a known manner, for example, by dissolving at least one polyvinyl alcohol having an average degree of polymerization of 300 to 3,000, and a degree of saponification of not less than 80%, in water to form a 5% to 30% aqueous solution, adding a foaming agent to the solution, and subjecting the solution to reaction with an aldehyde such as formaldehyde or acetaldehyde until the device becomes water insoluble. The polymer is 50 to 70 mole % of acetal units. In some embodiments, where the polymer has less than 50 mole % of acetal units, the retained polyvinyl alcohol may ooze out from the product upon use and contaminate the article to be cleaned. Where the polymer has more than 70 mole % of acetal units, the device may have poor elasticity and flexibility in other embodiments.

Although the above devices are generally described in selected shapes and sizes, alternative configurations can also be used. As merely an example, the polymeric product can have a gear-like configuration, which has numerous parallel grooves formed at an angle to the roll. Additionally, protrusions or projections on the surface of the foam product can include a variety of shapes, e.g., circular, ellipsoidal, rectangular, diamond, or the like. The total surface area occupied by the projections can range in value from about 10% or greater, or about 15% to about 65% or greater, most preferably 65%. Of course, the particular shape and size of the foam product depends upon the application.

Other techniques can also be used to manufacture porous polymeric devices used for surface treatment applications. These techniques include, among others, an air injected foam or sponge product.

The present devices have fewer impurities and/or particulates than conventional foam products. The concentration ranges of the impurities in a preferred embodiment are shown in Table 1. These impurity concentrations compare a conventional brush with the present brush. Concentrations are noted in parts per million and were derived using ion chromatography or ICPMS.

| Impurity | Conventional Brush (PPM) | Present Brush (PPM) |
|---|---|---|
| Fluoride | 13.0 | <.1 |
| Chloride | 5.0 | <1.0 |
| Nitrite | <0.5 | <0.01 |
| Bromide | <1.0 | <0.05 |
| Nitrate | <1.0 | <0.05 |
| Phosphate | <1.0 | <0.05 |
| Sulfate | 9.5 | <0.20 |

-continued

| Impurity | Conventional Brush (PPM) | Present Brush (PPM) |
|---|---|---|
| Lithium | <0.1 | <0.1 |
| Calcium | 7.3 | <0.05 |
| Magnesium | 3.2 | <0.01 |
| Potassium | 2.33 | <0.05 |
| Sodium | 243 | <0.10 |

Table 1 shows that the present invention provides a much cleaner device than conventional ones. In particular, the concentration of sodium, for example, which is detrimental to integrated circuits, is less than about 0.10 parts per million ("PPM") from a conventional value of about 243 PPM. In addition, the other impurities also have been substantially reduced by way of the present invention. The sodium concentration can also be less than 10 parts per million, less than 1 part per million, and lower in some applications. The present invention achieves these results by way of a novel cleaning procedure, which is described below in more detail.

Figure 2:
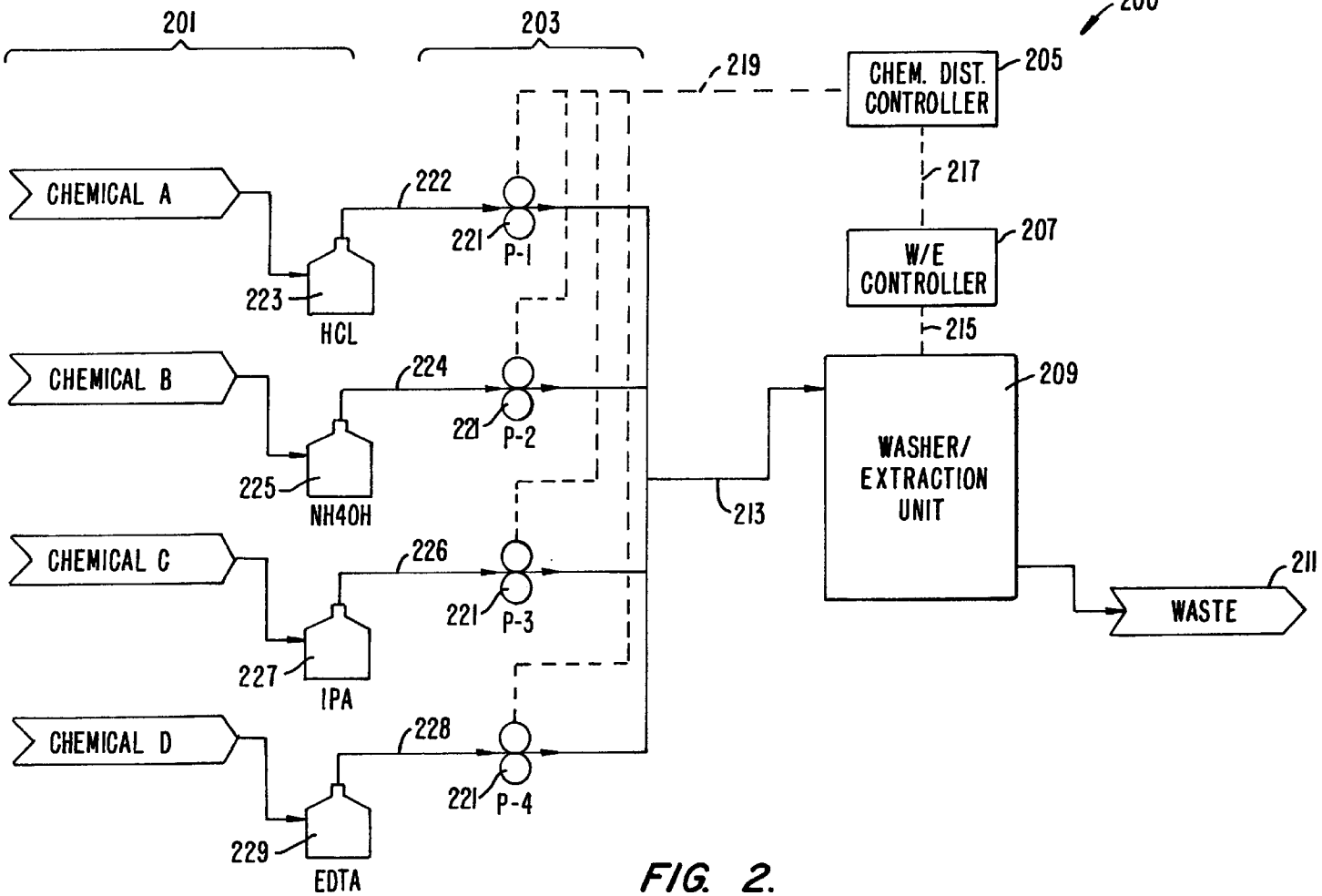
FIG. 2 is a simplified diagram of a cleaning system according to an embodiment of the present invention.

FIG. 2 is a simplified diagram of a cleaning system 200 according to an embodiment of the present invention. This Fig. is merely an illustration and should not limit the scope of the claims herein. One of ordinary skill in the art would recognize other variations, modifications, and alternatives. The simplified diagram shows a system 200, used to clean porous polymeric products (e.g., foam, sponge) to microclean or ultraclean levels. System 200 includes a variety of features such as a chemical source region 201, and a chemical metering region 203. A variety of chemicals used for cleaning are available in the chemical source region 201. These chemicals include, among others, acids, bases, solvents, and chelating agents. The chemicals preferably include hydrochloric acid (HCl) 223, ammonium hydroxide ($NH_4OH$) 225, isopropyl alcohol (IPA) 227, and ethylenediaminetetraacetic acid (EDTA) 229, but are not limited to these. Each of these chemical sources is coupled to a metering pump 221 through one of a plurality of lines 222, 224, 226, and 228. Line 222 connects metering pump 221 (P-1) to the HCl source, line 224 connects metering pump 221 (P-2) to the $NH_4OH$ source, line 226 connects metering pump 221 (P-3) to the IPA source, and line 228 connects metering pump 221 (P-4) to the EDTA source. All of these lines combine at a manifold, which directs the chemical or fluid to line 213, which connects to the washer/extraction unit 209. In other embodiments, the lines may be kept apart to be separate from each other.

The chemical source region is made of a suitable enclosure for preventing chemicals from escaping into the environment or onto the plant floor. In some embodiments, the source region is made by a chemically nonreactive material such as polypropylene, Kynar™, Teflon™, polyvinyl chloride, or others. In most embodiments, the source region is double contained. That is, chemicals escaping from any of the sources are trapped and drain out of the source region without escaping to the plant floor or environment. In other embodiments, the chemical source region is triple contained. Of course, the type of source unit used depends upon the nature and types of chemicals.

Pumps (P-1, P-2, P-3, P-4) are commonly controlled by a chemical distribution controller 205, which is electrically connected by line 219. Line 219 separates into a plurality of lines to control each of the pumps for metering purposes. For example, the metering pumps are capable of handling a wide variety of corrosive chemicals and solvents. These pumps are often units made by Nova Systems, but can be pumps made by other manufacturers.

Chemical distribution controller 205 communicates to the pumps through line 219, which that separates into independent lines to metering pumps 221. Chemical distribution controller 205 can be any suitable unit for metering chemicals from one of a plurality of chemical sources through one of a plurality of metering pumps. Alternatively, multiple pumps can be actuating to route more than one chemical source into the washer/extraction unit. The controller has input/output modules that receive and transmit signals to and from selected system elements. The controller is sufficiently chemical resistant and is durable for manufacturing operations. For example, the controller could be a product called Novalink, which is made by Nova Systems. Of course, other controllers can be used.

To oversee the operation of the system including the washer/extraction unit, a washer/extraction unit controller 207 couples to controller 205 through line 217 and couples to washer/extraction unit 209 through line 215. The controller has a variety of input and output modules. These modules are used to interface with sensors, motors, pumps, and the like from the washer/extraction unit, and with other apparatus or devices. The controller is a microprocessor-based unit which is coupled to memory, including dynamic random access memory, and program storage devices. A variety of process recipes can be stored in the memory of the controller. The controller is also sufficiently chemical resistant and is durable for manufacturing operations. For example, the controller could be from a Dubix machine. Of course, other controllers can be used.

Also shown is a waste stream 211 from the washer/extraction unit. The waste stream removes used fluids or undesirable fluids from the washer extraction unit. In preferred embodiments, the waste fluid stream is chemically balanced and is safe to health, environment, and property. In some embodiments, washer/extraction unit 209 uses a specific process recipe that produces an environmentally safe waste stream. Alternatively, the waste stream may be treated before returning fluids back to the environment.

Washer/extraction unit 209 is used with a variety of process recipes to clean and remove impurities from the foam product or products. The unit can be any suitable washing-machine-type unit with a variety of cleaning and rinsing cycles that are programmable. For example, the unit could be a product made by Dubix, but units made by other manufacturers could be used. The unit is made of a suitable material to be chemically resistant and clean to reduce any possibility of particulate contamination or the introduction of impurities onto the foam products. In preferred embodiments, the unit is a spin/rinse unit, which rotates a basket in a circular manner to clean and remove impurities from the foam product. The spin/rinse unit is preferably made of stainless steel or another relatively nonreactive material that does not introduce impurities into the porous polymeric product.

A process according to the present invention can be briefly outlined as follows:

(1) Provide products from manufacturer;

(2) Insert products into washer;

(3) Perform pre-wash with clean water;

(4) Perform solvent wash;

(5) Perform acid wash;

(6) Perform caustic wash;

(7) Perform EDTA wash;

(8) Perform rinse;

(9) Perform preservative wash;

(10) Perform dry;

(11) Perform additional steps, as required;

(12) Remove cleaned products; and

(13) Package cleaned products.

The above sequence of steps is used to substantially remove all particulate contamination and impurities from the porous polymeric devices. These devices are often "dirty" from the manufacturing process and should be substantially cleaned before use in a manufacturing operation, e.g., semiconductor fabrication. The above sequence of steps removes or substantially reduces quantities of ionic contamination and particulate. Although complex, the above sequence of steps is easily used in a washer unit with a programmable control unit. Depending upon the embodiment or embodiments, a rinse cycle or cycles may follow any of the above washes. Furthermore, the cleaned product is treated with a preservative (e.g., $NH_4OH$) to prevent breakdown or growth of contaminants such as bacteria on the product in storage or shipping. Accordingly, the present method can be easily implemented using conventional technology in a cost-effective manner.

Figure 3:
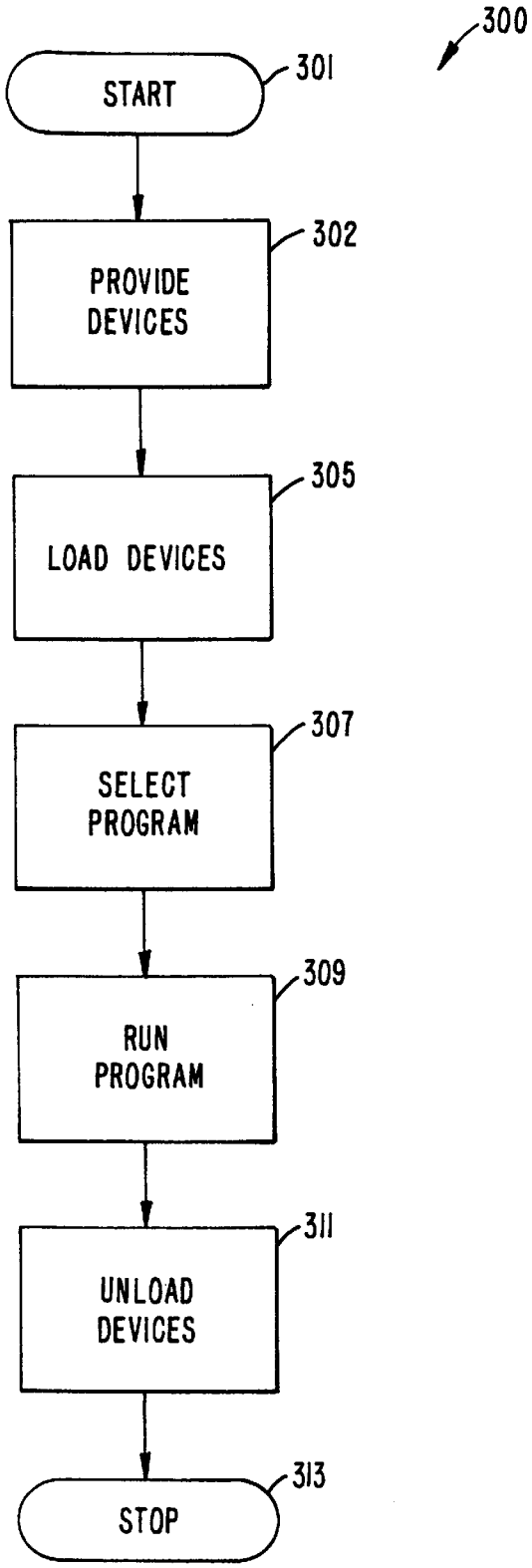
FIG. 3 is a simplified flow diagram of a cleaning method according to an embodiment of the present invention.

Some details of the above method are shown in FIG. 3, which illustrates a simplified flow diagram 300 of a cleaning (and packaging) method according to an embodiment of the present invention. FIG. 3 is presented merely as an illustration and should not limit the scope of the claims herein. One of ordinary skill in the art would recognize other variations, modifications, and alternatives.

For example, a process according to the present invention begins at step 301. The process has a step (step 302) of providing a plurality of porous polymeric devices, which require cleaning. These devices generally are from a manufacturer of polymeric devices or foam products. An example of this device is a product made by Kanebo Limited of Japan. Other companies also have similar devices. These companies include, among others, Cupps Industrial Inc., Merocel Scientific Products, Perfect and Glory Enterprise Co., Ltd. In generally all of the present embodiments, the polymeric devices include a variety of impurities that can be detrimental to the manufacture of integrated circuits, for example. These impurities should be removed or reduced in concentration before use in a clean or sensitive environment.

The devices are loaded (step 305) into a washer/extraction unit which can be programmed with a variety of process recipes to clean and remove impurities from the devices. The washer/extraction unit may rotate the devices. The unit can be any suitable washing machine-type unit with a variety of cleaning and rinsing cycles that are programmable. The unit is made of a suitable material, chemically resistant and clean, to reduce any possibility of particulate contamination or the introduction of impurities onto the devices to be cleaned. In preferred embodiments, the unit is a spin/rinse unit, which rotates a basket in a circular manner, to clean and remove impurities from the devices. The rotational action provides mechanical agitation to fluids that tend to loosen and remove impurities and particulate matter from the devices. In one embodiment, further details of a cleaning process are explained in U.S. patent application No. 9/193,009 filed Nov. 16, 1998 (18886-001110US), entitled "A Microcleaning Process For Sponge Or Porous Polymeric Products," commonly assigned.

A program according to this embodiment is selected from the washer/extraction unit. The program is often loaded into a controller. This program can carry out a variety of cleaning processes. This program removes a substantial amount of impurities and particulate contamination from the devices. After the process, the devices are substantially free from impurities. For example, the impurities would be fewer than those noted in Table 1. The cleaned or microcleaned devices are removed (step 311) from the washer/extraction unit in a cleanroom environment before packaging. The packaging step (step 315) may then be performed within the cleanroom. The cleanroom environment is generally at least a Class 100 or Class 10 cleanroom, thereby preventing additional contamination of the devices. The process stops at step 313, but additional steps can be performed as desired.

In a preferred embodiment, the cleaned devices are packaged in a preservative such as a basic solution or the like. The preservative can be added or introduced into the product during one of the last cycles in the washer. The preservative can also be added to the devices after being cleaned. The techniques for introducing the preservative can include spraying, vaporizing, wetting, soaking, and others. Of course, other techniques can also be used to preserve the cleaned product during storage or shipping. Details of the packaging method according to an embodiment of the present invention are shown below in the FIGS.

Figure 4:
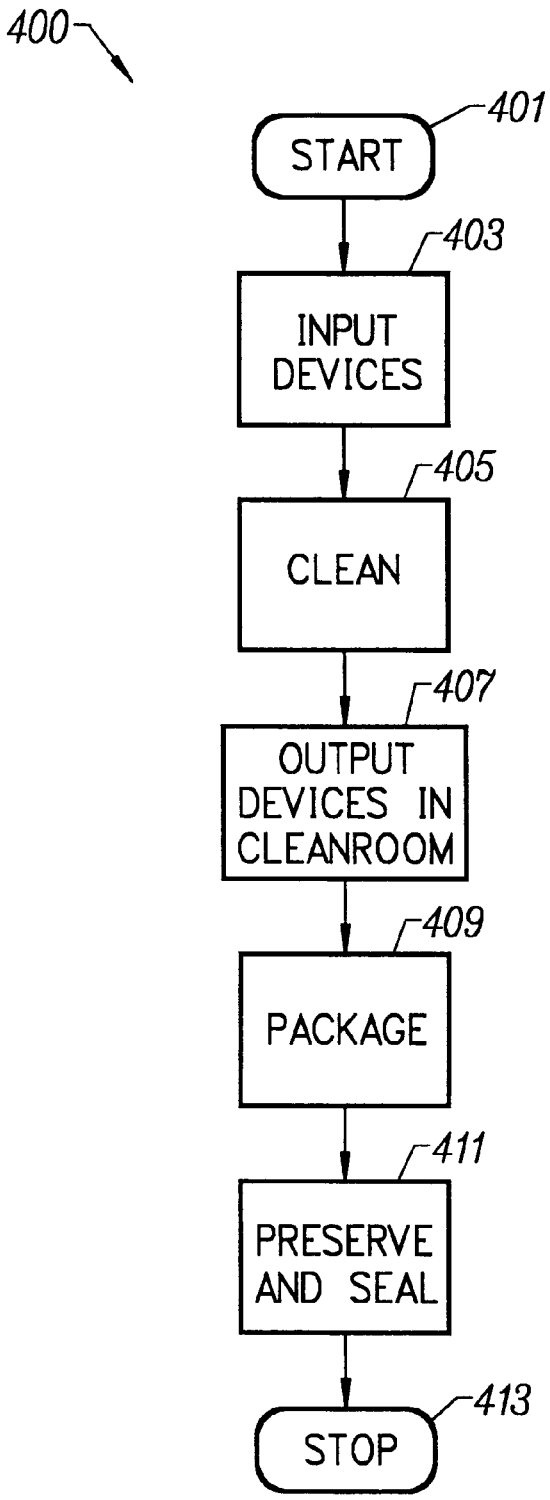
FIG. 4 is a simplified flow diagram of a cleaning and packaging method according to an embodiment of the present invention.

FIG. 4 is a simplified flow diagram of a cleaning and packaging method 400 according to an embodiment of the present invention. This FIG. is merely an illustration and should not limit the scope of the claims herein. One of ordinary skill in the art would recognize other variations, modifications, and alternatives. The present method 400 begins at start, step 401. The method has a step (step 403) of providing or inputting a plurality of porous polymeric devices, which require cleaning. These devices generally are from a manufacturer of polymeric devices or foam products such as the ones noted as well as others. An example of this device is a product made by Kanebo Limited of Japan. Other companies also have similar devices. These companies include, among others, Cupps Industrial Inc., Merocel Scientific Products, Perfect and Glory Enterprise Co., Ltd. In generally all of the present embodiments, the polymeric devices include a variety of impurities that can be detrimental to the manufacture of integrated circuits, for example. These impurities should be removed or reduced in concentration before use in a clean or sensitive environment.

In a specific embodiment, the devices are cleaned, step 405. In particular, the devices are loaded into a washer/extraction unit which can be programmed with a variety of process recipes to clean and remove impurities from the devices. The washer/extraction unit may rotate the devices. The unit can be any suitable washing machine-type unit with a variety of cleaning and rinsing cycles that are programmable. As merely an example, the unit is a product made by Dubix of France, but units made by other manufacturers can be used. The unit is made of a suitable material, chemically resistant and clean, to reduce any possibility of particulate contamination or the introduction of impurities onto the devices to be cleaned. In preferred embodiments, the unit is a spin/rinse unit, which rotates a basket in a circular manner, to clean and remove impurities from the devices. The rotational action provides mechanical agitation to fluids that tend to loosen and remove impurities and particulate matter from the devices.

After the cleaning process, the devices are substantially free from impurities. For example, the impurities would be fewer than those noted in Table 1. The cleaned or microcleaned devices are removed (step 407) from the washer/extraction unit in a cleanroom environment before packaging. The cleanroom environment is generally at least a Class 100 or Class 10 or Class 1 cleanroom, thereby preventing additional contamination of the devices. The Class 1 cleanroom has fewer than 1 particle greater than about 0.1 micron in a volume of a cubic foot. In a specific embodiment, the output of the washer/extraction unit faces into the cleanroom. Alternatively, the washer/extraction unit has a passthrough, which connects or couples to the cleanroom. Still further, the package can come out of the washer/extraction unit and placed in a clean module such as a SMIF unit or the like. The SMIF unit couples to a packaging apparatus, which seals the device in a substantially particle free package.

In a preferred embodiment, a preservative is added to the devices after one of the wash cycles. The preservative can be any suitable compound or compounds that reduce or minimize damage to the porous polymeric material. In one aspect, the preservative can be any high pH bearing compound that reduces the ability for bacterial or other organisms to grow on the porous polymeric material. In the present example, the preservative can be ammonium hydroxide, ammonium, TMAH, and other compounds. Alternatively, the preservative can be a low pH bearing compound such as oxalic acid, citric acid, and dehydroacetic acid. Still further, the preservative can also be other organic biocides. In an embodiment using ammonium hydroxide, for example, the pH on the polymeric product is greater than about 9.0 pH or greater than about 9.5 pH, but can also be others. Of course, the type of preservative depends highly upon the type of porous polymeric material and the like. In a specific embodiment, the preservative can also be added to the devices after being cleaned, but outside the washer/extraction unit. The techniques for introducing the preservative can include spraying, vaporizing, wetting, soaking, and others. Of course, other techniques can also be used to preserve the cleaned product during storage or shipping.

The packaging step (step 409) is then performed within the cleanroom or other clean environment. The packaging step occurs by transferring the clean device into a substantially contaminant free package such as a polyethylene bag or other product. The package can be any suitable particulate free material that can provide a substantially clean environment. The package can be a plastic material such as polyethylene, polyvinyl chloride, nylon, and others. The package can also be laminated for strength and durability. An example of a laminated package is Precision Clean II made by Fisher Container Corp. of Evanston, Ill., but can also be others. The package generally has been processed in at least a Class 10 Cleanroom and meets FFC Level 1 surface cleanliness standards. The material construction can be polyethylene. The material is preferably substantially amine-free and organic-free and contains substantially no silicon and/or slip agents.

In a specific embodiment, the package including the device and preservative is sealed (step 411). In some embodiments, preservative can be added to the package itself, which coats the devices. The package can be sealed using a variety of techniques such as heat seal, glue, locks, staples, and other fastening devices. The sealed package does not allow any of the preservative material or porous polymeric product to escape into the environment. Additionally, particulate contamination and/or trace materials cannot leech into the sealed package. The package can be sealed using a heat sealer called "Foot Impulse Sealer" and made by a company called American International Electric Co. of Taiwan, but is not limited to this product. The process stops at step 413, but additional steps can be performed as desired.

The packaged devices often occupy a selected region of the package for handling purposes. In one embodiment, the device occupies about 70 percent or more of the interior region of the package. Alternatively, the device occupies about 80 percent or more of the interior region of the package. In a specific embodiment, only a single device is packaged at once. Alternatively, more than one device such as two or more can be placed in a package. The package can also be vacuum sealed to prevent oxidizing materials from damaging the porous polymeric product. The device also can be sealed with an inert gas or non-reactive gas such as nitrogen, argon, helium, or the like. In one aspect, each of the packaged devices is placed in a larger package or plastic container for shipping purposes. That is, the package is at least double contained or preferably triple contained.

Figure 4A:
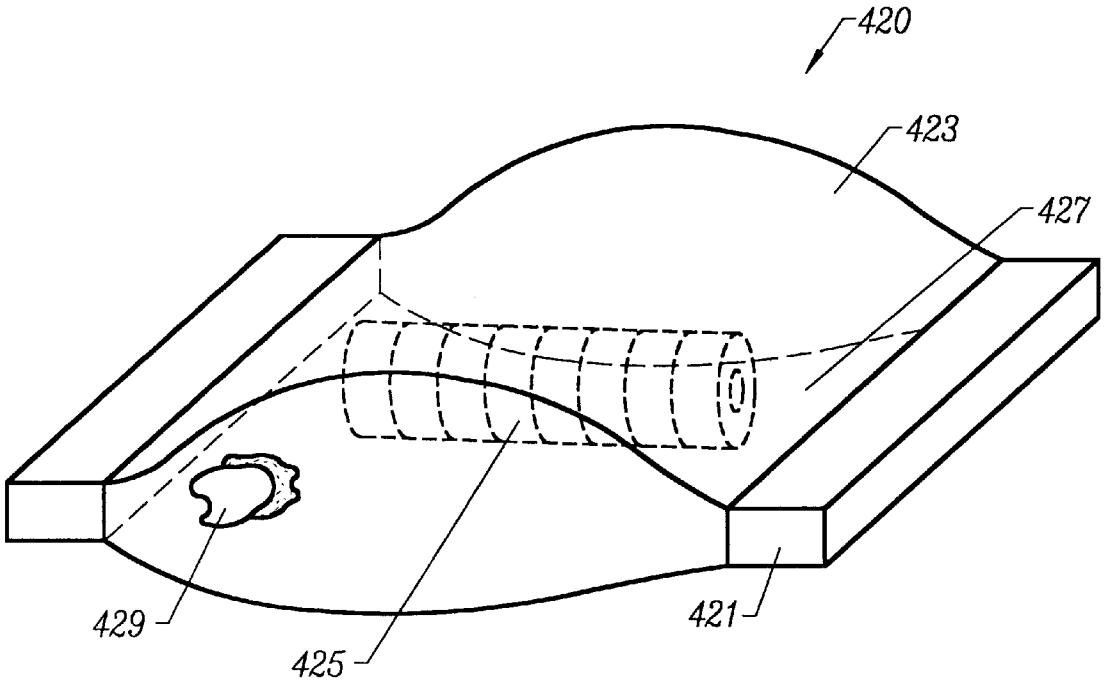
FIG. 4A is a simplified pictorial diagram of a packaged device according to an embodiment of the present invention.

FIG. 4A is a simplified diagram 420 of a packaged device according to an embodiment of the present invention. This diagram is merely an illustration which should not limit the scope of the claims herein. One of ordinary skill in the art would recognize other variations, modifications, and alternatives. The packaged device includes a device 425, which has been treated with a preservative, and a packaging member or package 423. Each side of the package 423 is sealed 421. An interior volume or portion 427 of the package may include a non-reactive gas, or be evacuated, depending upon the application. Alternatively, the volume may include a preservative, which has been placed in a smaller package 429. The smaller package emits the preservative in a predetermined manner to preserve the device during transit and storage, for example. The device has been placed into the package without contact with human hands. For example, the device can be placed into the package with tongs, gloved hands, a robot harm, and other techniques, which substantially reduce a presence of particulate contamination on the device. The device and interior volume of the package are substantially free from trace metals and mobile ions. Additionally, the device and interior volume of the package are substantially free from particles greater than about 0.5 micron in dimension, or about 0.25 micron in dimension, or about 0.1 micron in dimension, or about 0.05 micron in dimension. Details of removing the device from the package are shown below in the Fig.

Figure 5:
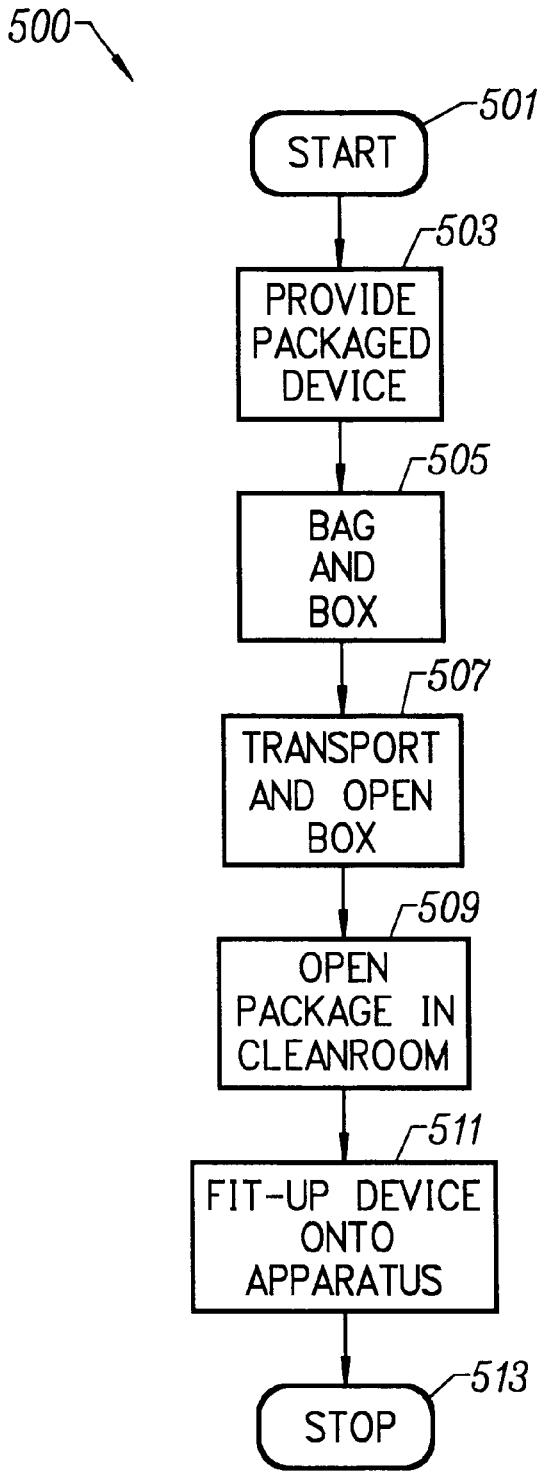
FIG. 5 is a simplified flow diagram of an unpackaging method according to an embodiment of the present invention.

FIG. 5 is a simplified flow diagram of an unpackaging method 500 according to an embodiment of the present invention. This Fig. is merely an illustration and should not limit the scope of the claims herein. One of ordinary skill in the art would recognize other variations, modifications, and alternatives. The present method 500 begins at start, step 501. The packaged devices are often provided (step 503) in a double or triple contained package. In a specific embodiment, each of the devices is placed in individual packages, which are placed in a larger package, typically plastic, or other particle free material. The larger package is often placed in a cardboard container (step 505), which has been laminated to reduce the amount of particulate contamination.

The cardboard container, including the devices, is shipped (step 509) to a user site, such as a wafer, integrated circuit, or disk drive company. The user site often opens the container and removes the larger package from the container. A user generally inspects the contents of the container for quality control. The larger package is often cleaned using a moist clean wipe. The larger package is placed in an air shower to remove any loose particulate contaminants from the exterior surfaces of the package. The package is then placed into a cleanroom or the like. The individual device including the package is opened in the cleanroom, where it is clean and free from particulate contamination. Depending upon the application, the device is placed on an apparatus (e.g., scrubbing system) for use. An example of such an apparatus is shown below by way of the Fig.

Figure 6:
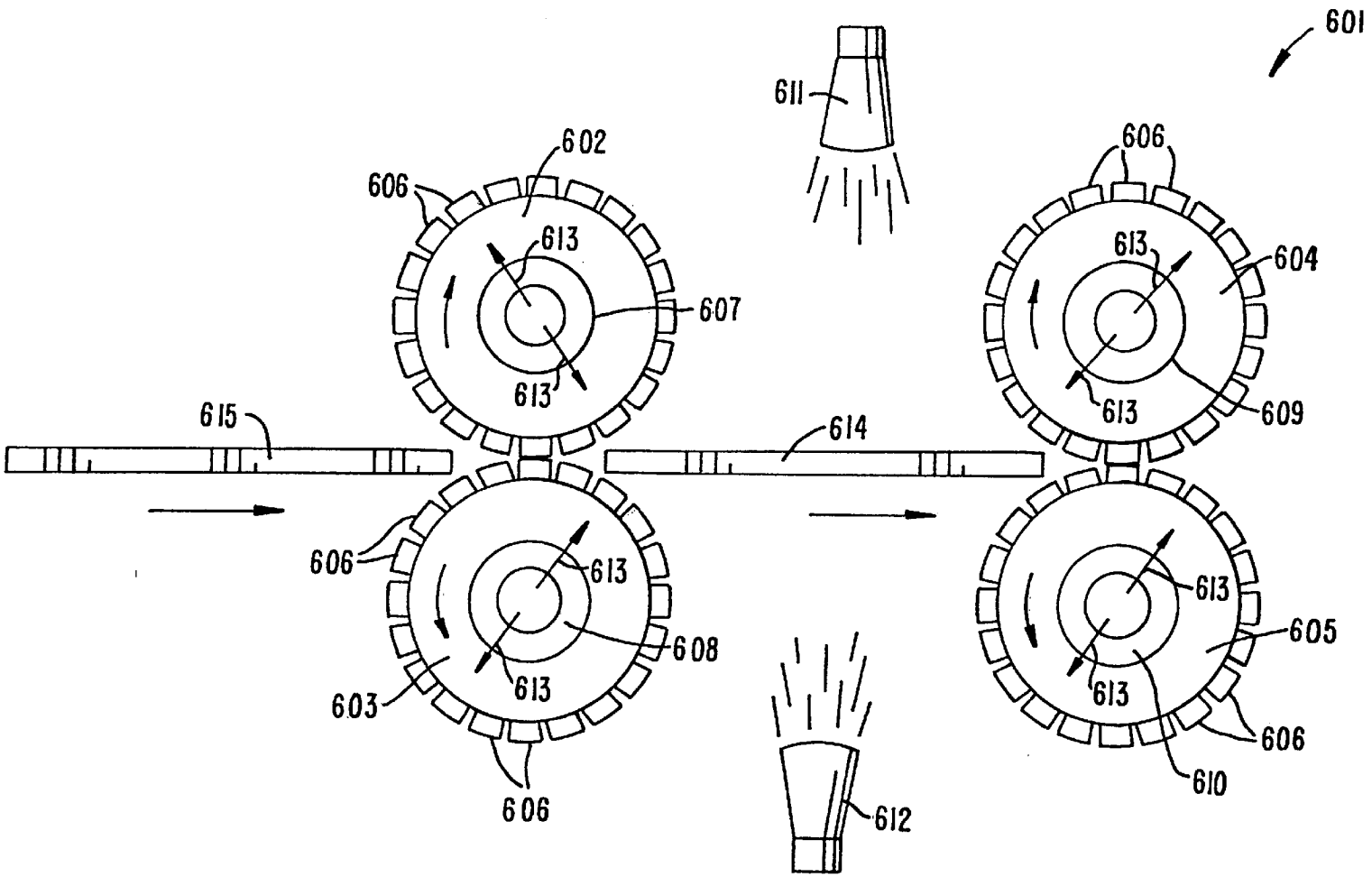
FIG. 6 is a simplified diagram of a scrubbing system according to an embodiment of the present invention

FIG. 6 is a simplified diagram of a scrubbing process 600 according to an embodiment of the present invention. This Fig. is merely an illustration and should not limit the scope of the claims herein. One of ordinary skill in the art would recognize other variations, modifications, and alternatives. The scrubbing process uses the cleaned devices according to the present invention. As shown in the Fig., a semiconductor product wafer cleaning system 601 has two brush stations, a first comprising cylindrical PVA brushes 602 and 603, and a second comprising cylindrical PVA brushes 604 and 605. On each of the brushes, there are projections 606 also made of PVA. The brushes are mounted on spindles 607, 608, 609 and 610 so that they are barely touching and rotate in the direction indicated. Deionized water is sprayed from nozzles 611 and 612 and pumped 613 through the brushes from the spindles. The combination of the water and brush contact acts to remove residual cleaning composition from a semiconductor product wafer 614 which is passed through the brushes in the cleaning stations.

In order to remove the slurry or other residue, deionized water and/or cleaning chemistries sprayed from nozzles above and below impinges the wafers. As the brushes rotate over the surface of the wafer, they tend to pick up and trap in the brush surface particles of the slurry and other residue of the cleaning composition. Additionally, deionized water may be pumped through holes in the spindle to saturate the tubular brushes. The slurries which eventually contaminate the cleaning brushes and render them ineffective for further cleaning comprise the slurries and other cleaning compositions described in the background section of this application.

The cleaning brushes used in post CMP cleaning operations is employed in connection with resilient foam brushes such as those used on the Synergy wafer cleaning system manufactured by OnTrak Systems, Inc. of Milpitas, Calif. This system employs multiple sequential cleaning stations wherein each station comprises a pair of tubular brushes made of polyvinyl alcohol (PVA) in the form of a sponge. Each brush has a length of approximately 10 in. (25.4 cm), an outside diameter of approximately 2⅜ in. (6.0 cm) and an inside diameter of approximately 1¼ in. (3.2 cm), and has an outer cylindrical surface covered with sponge projections approximately ¼ in. (0.5 cm) in height and A in. (0.7 cm) in diameter. Each brush is rotatably mounted on a spindle through which may be pumped water to saturate the brush and the brushes at each station are spaced so that the surfaces approximately contact each other. Given the resilience of the sponge, this permits thin semiconductor wafers containing the cleaning composition residue to pass between the pairs of brushes as they rotate. Typically, as the cleaning system will have two (2) stations, with each station having a pair of the brushes as described above. The wafers pass directly from one station through the other.

The process described above is merely an example of a technique that can be performed to provide ultraclean surface treatment devices according to an embodiment of the present invention. The present invention can also be performed in a "batch" type process, where various cleaning solutions are applied to the devices in a sequential manner. This batch type process would include, among other techniques, immersion of the devices in tanks and sprays.

The semiconductor product wafers that may be cleaned by the system referenced herein include silicon, silicon nitride, silicon oxide, polysilicon or various metals and alloys. As used herein the term "product wafer" refers to the wafer which is to be intended to be produced by further treatment in a semiconductor device. The CMP compositions which are used to planarize or otherwise treat and polish the surface of the semiconductor product wafers must be removed to a degree sufficient to allow subsequent manufacture and deposition steps to be made to a clean surface. Although the above embodiments are generally described in terms of semiconductor manufacturing, the invention has a much broader range of applicability. For example, the invention can be applied to a manufacturing process for wafers, hard disks, flat panel displays, and other devices that require a high degree of cleanliness. In addition, the present invention can be used to replenish or rework "dirty" sponge products. Accordingly, the present invention is not limited to cleaning products prior to a manufacturing process.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A storable porous polymeric device comprising:

a porous polymeric member, the member comprising an outer surface and a plurality of impurities distributed through the member, said plurality of impurities including a sodium concentration of less than about 0.2 parts per million;

a preservative applied to said porous polymeric member; and a containment package enclosing and sealing said preservative and said porous polymeric member within said containment package.

2. The device of claim 1 wherein said preservative capable of repelling charged particles from the porous polymeric member.

3. The device of claim 1 wherein containment package is heat sealed.

4. The device of claim 1 wherein said containment package is provided to enclose and seal said porous polymeric member in a cleanroom to substantially reduce particulate contamination from said porous polymeric member.

5. The device of claim 1 further comprising a package including a preservative therein within said containment package to preserve said porous polymeric member.

6. The device of claim 1 wherein said containment package is a class 10 clear polymer bag.

7. The device of claim 1 wherein said porous polymeric member is selected from a material including polyvinyl acetal porous elastic material.

8. The device of claim 1 wherein said porous polymeric member has a sodium concentration level of less than 0.20 parts per million.

9. The device of claim 1 wherein the porous polymeric member is selected from a brush, a puck, a pad, or a plug.

10. The device of claim 1 wherein said preservative comprises an ammonium bearing compound.

11. The device of claim 1 wherein said preservative comprises an ammonium hydroxide compound to increase a pH factor of said porous polymeric member to reduce a bacterial growth on said porous polymeric member.

12. A packaging apparatus for porous polymeric members, said packaging apparatus comprising:

a porous polymeric member comprising a volume of polyvinyl alcohol material;

a preservative applied homogeneously through said volume of polyvinyl alcohol;

a containment member applied to enclose and seal said porous polymeric member and said preservative within said containment member;

wherein said preservative prevents substantial growth of an organic matter on said porous polymeric member.

13. The apparatus of claim 12 wherein said preservative comprises an ammonium bearing compound to increase a pH factor of said porous polymeric member.

14. The apparatus of claim 12 wherein said containment member is heat sealed to seal and enclose said porous polymeric member and said preservative within said containment member.

15. The apparatus of claim 12 wherein said porous polymeric member is characterized by a shelf live of at least one year from a packaging date for said porous polymeric member.

16. The apparatus of claim 12 further comprises an outer enclosure for enclosing and sealing said containment member.

17. The apparatus of claim 12 wherein said wherein said containment member comprises an inert gas within said containment member.

* * * * *